US005937151A

United States Patent [19]

Kadota

[11] Patent Number: 5,937,151

[45] Date of Patent: Aug. 10, 1999

[54] METHOD FOR SETTING ERROR PRINT OUTPUT MODE

[75] Inventor: Masatoshi Kadota, Takahama, Japan

[73] Assignee: Brother Kogyo Kabushiki Kaisha, Nagoya, Japan

[21] Appl. No.: 08/870,729

[22] Filed: Jun. 6, 1997

[30] Foreign Application Priority Data

Jun. 7, 1996 [JP] Japan ..... 8-146184

[51] Int. Cl.[6] ..... B41J 29/42

[52] U.S. Cl. ..... 395/114; 395/112; 395/113; 395/200.11; 395/200.12; 395/200.17; 399/9; 399/10; 399/11; 347/19; 358/406; 358/407; 714/2; 714/5; 714/47; 714/48; 714/57

[58] Field of Search ..... 395/112–114, 200.11, 395/200.12, 200.17; 399/9–11; 347/19; 358/406, 407; 714/2, 5, 47, 48, 57

[56] References Cited

U.S. PATENT DOCUMENTS 5,696,899 12/1997 Kalwitz ..... 395/200.1
5,699,494 12/1997 Colbert et al. ..... 395/114
5,727,135 3/1998 Webb et al. ..... 395/114
5,812,745 9/1998 Kim et al. ..... 395/113
5,845,057 12/1998 Takeda et al. ..... 395/114

FOREIGN PATENT DOCUMENTS

A-62-109674 5/1987 Japan ..... B41J 29/46
A-63-39371 2/1988 Japan ..... B41J 29/46

*Primary Examiner*—David K. Moore
*Assistant Examiner*—Lance W. Sealey
*Attorney, Agent, or Firm*—Oliff & Berridge, PLC

[57] ABSTRACT

An error print output setting method for controlling whether an error message is printed out by a printer when an error occurs. The method includes a step to judge whether the status monitor indicative of the status of a printer is to be displayed on the display of a personal computer in S1080. If the setting indicates that the status monitor is to be displayed on the personal computer, the error print output option is set to "off" in S1100. Therefore, when a printing error occurs, an error message is displayed on the computer display and not printed out by the printer. Thus, excessive waste of paper can be prevented.

37 Claims, 9 Drawing Sheets

METHOD FOR SETTING ERROR PRINT OUTPUT MODE

BACKGROUND OF THE INVENTION

1. Field of the Invention

The present invention relates to a method of controlling a data processing device and a printing device to inform a user of an error status when an error occurs while the printing device performs a printing operation.

2. Description of the Related Art

In recent years, the configurations of printers well-known in the art have been simplified. For example, LCD display units in the printers have been omitted, the number of switches has been decreased, and the control panels have been simplified.

As a result, when a printing error occurs, the printer itself cannot display the problem due to the simplified configuration. However, since it is necessary that the user be notified with an error message when an error occurs, one method known in the art is to print the error message on printing paper. This method will be referred to as error print output operation.

Another method known in the art is to display the error messages on the display unit of a data processing device, such as a personal computer. To achieve this method, the printing device does not simply receive print data and commands from the data processing device, but also transmits a type of status signals, or "error signals," to the data processing device.

SUMMARY OF THE INVENTION

The error print output method described above is not popular because, first of all, it is a waste of printing paper. Second, after an error message is outputted and the printer recovers from the error, the data received from the data processing device still remains in the printer buffer, not printed due to the error. After recovering from the error, the printer sometimes outputs this data in the same form as the error print output, requiring the data processing device to resend the data to be printed again. Such a process reduces working efficiency and wastes printing paper.

The second method described above requires bidirectional communication between the printer and the data processing device. In addition, the data processing device must incorporate a device driver, or similar program, that can decipher the status signals sent from the printer and display the status of the printer on the display unit. Further, even if the user sets the data processing device to display this status, error messages cannot always be displayed according to the kind of the data processing device being used.

However, if the user does not set the printer setting to turn off error print outputs, or if the user does not know how to set that printer setting, the printer will produce an error print output when an error occurs even if the data processing device is capable of deciphering status signals sent from the printer and displaying error messages on the display unit. Hence, the above-described problems concerning wastefulness and inefficiency will still exist.

On the other hand, if the user does not set the printer setting to turn on error print outputs, or if the user does not know how to set that printer setting, the printer will not output an error print output when an error occurs even if the data processing device is incapable of bi-directional communications. In such a case, if the printer does not print, much time might be required to determine what error occurred, reducing the wording efficiency.

In view of the foregoing, it is an object of the present invention to provide a method of controlling a data processing device and a printing device to inform a user of an error status when an error occurs while the printing device performs a printing operation.

According to the present invention, the printer is automatically set not to produce error print outputs when the data processing device can display the error, and the printer is automatically set to produce error print outputs only when the data processing device cannot display the error.

That is, the present invention provides a method of controlling a data processing device and a printing device, connected to each other, to perform a printing operation, the method comprising the steps of: judging whether or not a data processing device, connected to a printing device, is capable of displaying a status monitor indicative of a status of the printing device; setting the printing device into an error print output execution mode for performing an error print output operation when the data processing device is judged not to be capable of displaying the status monitor and setting the printing device into an error print output non-execution mode not for performing the error print output operation when the data processing device is judged to be capable of displaying the status monitor; and sending print data from the data processing device to the printing device, thereby controlling the printing device to perform printing operation. When the data processing device is capable of displaying the status monitor, the data processing device may request the printing device to send status signals, analyze the status signals, and display the analyzed status of the printing device on a display while the printing device performs printing operation. In this case, the printing device, set in the error print output non-execution mode, may not produce an error print output when an error occurs. On the other hand, when the data processing device is not capable of displaying the status monitor, the printing device, set in the error print output execution mode, will produce an error print output indicative of an error when the error occurs during the printing operation.

According to another aspect, the present invention provides a control device for controlling a printing device to perform a printing operation, the control device comprising: means for displaying a status monitor indicative of a status of a printing device; means for judging whether or not the displaying means is in a state capable of displaying the status monitor; means for setting the printing device into an error print output execution mode for performing an error print output operation when the displaying means is judged not to be capable of displaying the status monitor and setting the printing device into an error print output non-execution mode not for performing the error print output operation when the displaying means is judged to be capable of displaying the status monitor; and means for sending print data to the printing device, thereby controlling the printing device to perform printing operation.

According to still another aspect, the present invention provides a printing device for performing a printing operation, the printing device comprising: means for receiving print data from a data processing device and for performing a printing operation with the received print data; means for performing an error print output operation to produce an error print output when an error occurs during the printing operation; means for sending, to the data processing devices a status signal indicative of a status of the printing means; means for judging whether or not the status signal sending means is in a state capable of sending the status signal to the data processing device; and means for setting the error print output means into an error print output execution mode for performing the error print output operation when the status signal sending means is judged not to be capable of sending the status signal and setting the error print output means into an error print output non-execution mode not for performing the error print output operation when the status signal sending means is judged to be capable of sending the status signal.

According to another aspect, the present invention provides a program storage medium for storing data of a program indicative of a process for controlling a data processing device to control a printing device to perform a printing operation, the program comprising: a program of judging whether or not a data processing device, connected to a printing device, is capable of displaying a status monitor indicative of a status of the printing device; a program of setting the printing device into an error print output execution mode for performing an error print output operation when the data processing device is judged not to be capable of displaying the status monitor and setting the printing device into an error print output non-execution mode not for performing the error print output operation when the data processing device is judged to be capable of displaying the status monitor; and a program of sending print data to the printing device, thereby controlling the printing device to perform printing operation.

According to a further aspect, the present invention provides a program storage medium for storing data of a program indicative of a process for controlling a printing device to perform a printing operation, the program comprising: a program of judging whether or not a data processing device, connected to a printing device, is capable of displaying a status monitor indicative of a status of the printing device; a program of setting the printing device into an error print output execution mode for performing an error print output operation when the data processing device is judged not to be capable of displaying the status monitor and setting the printing device into an error print output non-execution mode not for performing the error print output operation when the data processing device is judged to be capable of displaying the status monitor; and a program of performing printing operation with print data sent from the data processing device.

DETAILED DESCRIPTION OF THE PREFERRED EMBODIMENTS

Preferred embodiments of a method of controlling a data processing device and a printing device according to the present invention will be described below while referring to the accompanying drawings.

A first embodiment of the present invention will be described below with reference to FIGS. 1 through 6.

Figure 1:
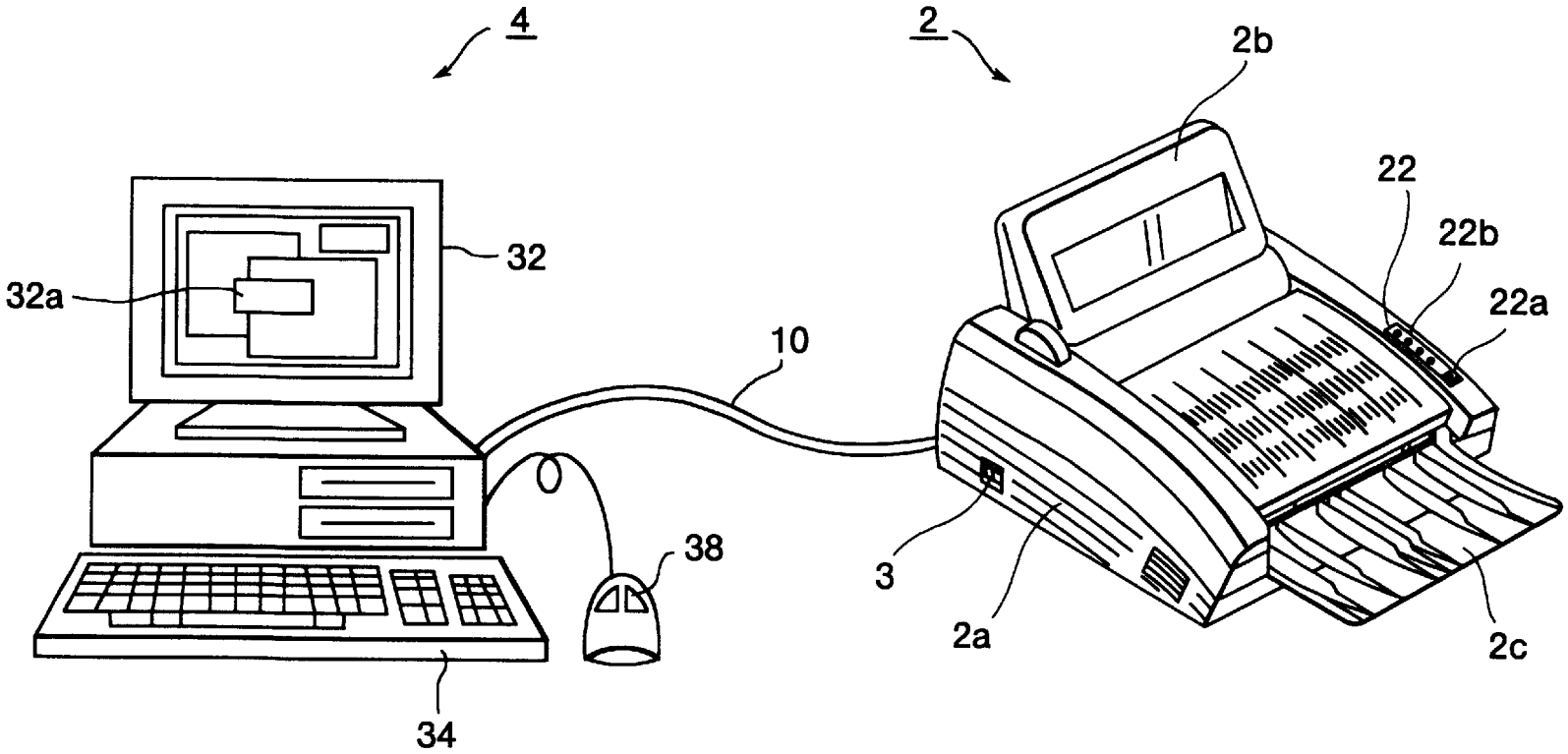
FIG. 1 is an explanatory diagram showing a personal computer connected to a laser printer in a first embodiment of the present invention.
Figure 2:
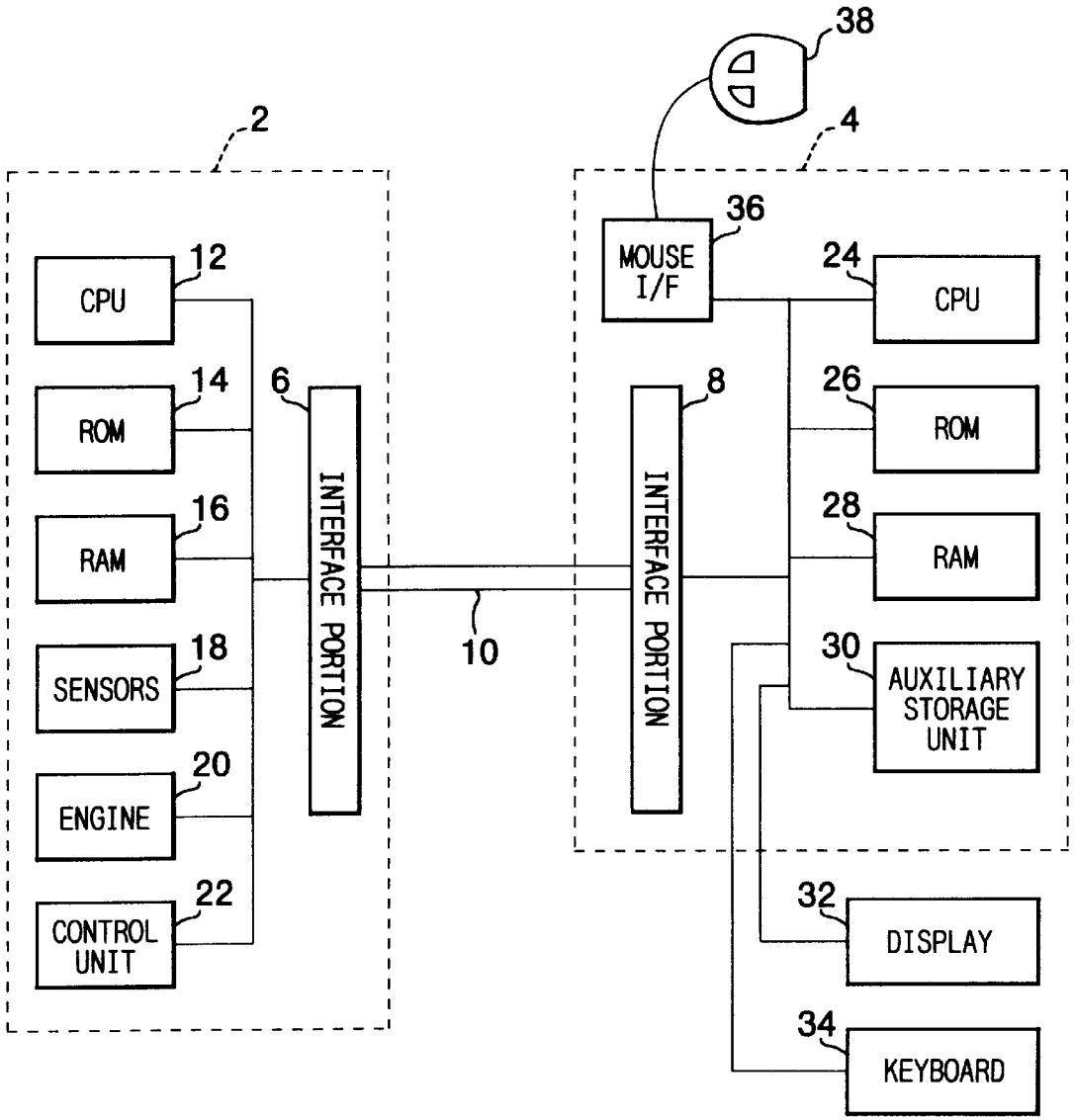
FIG. 2 is a block diagram showing the configuration of the personal computer and laser printer.

In order to perform the method of the first embodiment, as shown in FIGS. 1 and 2, a personal computer 4 is connected to a laser printer 2 by a parallel printer cable 10 via interface units 6 and 8.

The laser printer 2 includes a main body 2*a*, a paper feed unit 2*b*, and a paper discharge tray 2*c*. During the printing process, one sheet of paper is fed at a time from the paper feed unit 2*b* into an image forming unit (not shown). After a toner image is formed on the sheet of paper, the toner is heated by a fixing unit (not shown) to be thermally fixed on the paper. Then, the paper is discharged onto the paper discharge tray 2*c*.

Figure 5:
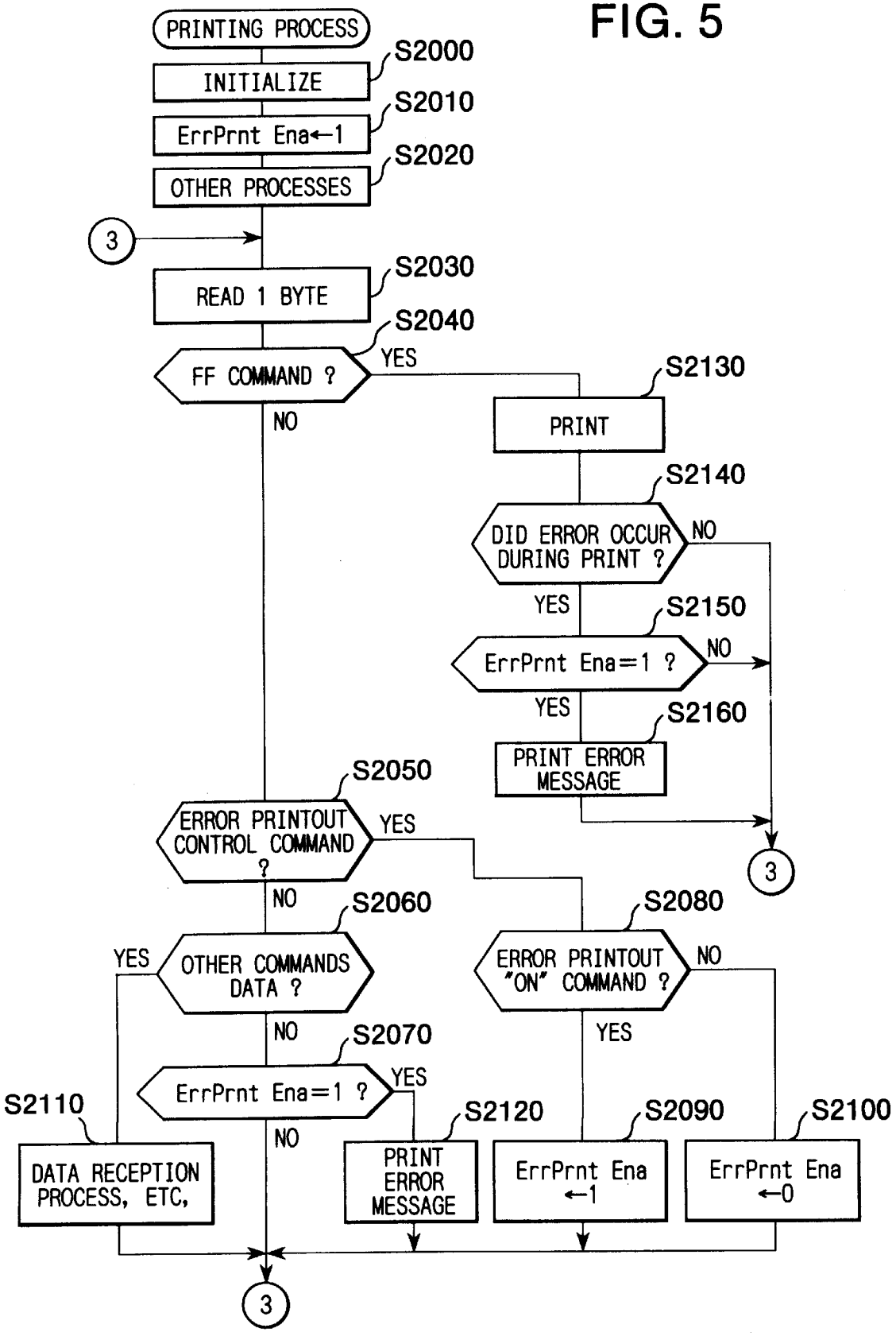
FIG. 5 is a flowchart showing the process performed in the laser printer of the first embodiment.

Internally, the laser printer 2 includes the interface unit 6 for interfacing with the personal computer 4 in accordance with a predetermined printer parallel interface standard such as a standard "IEEE 1284"; a CPU 12 for executing various processes according to various control programs; a ROM 14 storing the various control programs including a program shown in FIG. 5; a RAM 16 for use as a work area for calculations to be executed by the CPU 12 and for storing results of those calculations and various settings; various sensors 18, including a paper feed sensor, a paper discharge sensor, and a toner sensor; and an engine 20 including a main motor for driving mechanical portions in the laser printer 2. A control unit 22 and a power switch 3 are also provided in the main body 2*a* of the laser printer 2 as shown in FIG. 1. Those components 12, 14, 16, 18, 20, and 22 are connected to the interface 6 via bus line. The control unit 22 includes a push-button switch 22*a* for providing simple instructions to the laser printer 2, and LED lights 22*b* for displaying the status of instruction controls to allow the user to set prescribed conditions.

The personal computer 4 includes the interface unit 8; a CPU 24; a ROM 26; a RAM 28; an auxiliary storage unit 30; a display 32; a keyboard 34; and a mouse interface 36 which are connected to one another via bus line. A mouse unit 38 is connected to the mouse interface 36.

The interface unit 8 is for interfacing with the laser printer 2 in accordance with the predetermined parallel interface standard. The CPU 24 is for executing various processes according to various control programs stored in the ROM 26 and the RAM 28. The ROM 26 stores therein various control programs. The auxiliary storage unit 30 such as a hard disk is for storing data and external programs, such as an operating system program, application programs, a printer device driver program PD shown in FIGS. 3 and 4, and a status monitor program SP, which are retrieved from auxiliary storage media such as floppy disks, CD-ROMs, magnetooptical disks, and the like. The RAM 28 is for storing data and programs such as the operating system program, the application programs, the printer device driver program PD, and the status monitor program SP. which are read from the auxiliary storage unit 30 when these programs are to be executed. The RAM 28 is also for storing results of calculations attained by the CPU 24 and various settings. The display 32 is for displaying the results of calculations, menus, a printing process display for the printer 2, and a status monitor of the printer 2, and the like. The keyboard 34 is for enabling a user to input various instructions. The mouse unit 38 is for moving a mouse cursor displayed on the display 32 and for allowing the user to input instructions. The mouse unit 38 is for communicating data of such movement and instructions with the CPU 24 via the mouse interface 36.

The personal computer 4 and the laser printer 2 exchange handshake signals needed for transmitting data. The handshake signals include strobe signals and acknowledge signals. The personal computer 4 transmits print data and instruction commands to the printer 2. The laser printer 2 executes printing processes according to the instruction commands and the print data, and outputs its status signals to the personal computer 4 in the form of status signals.

As described above, each of the operating system program, the application programs, the printer driver program PD, and the status monitor program SP has been recorded in an auxiliary storage medium such as a floppy disk, a CD-ROM, or a magnetooptical disk. When each program is installed into the computer 4, the program is retrieved from the auxiliary storage media and stored into the auxiliary storage unit 30.

Figure 3:
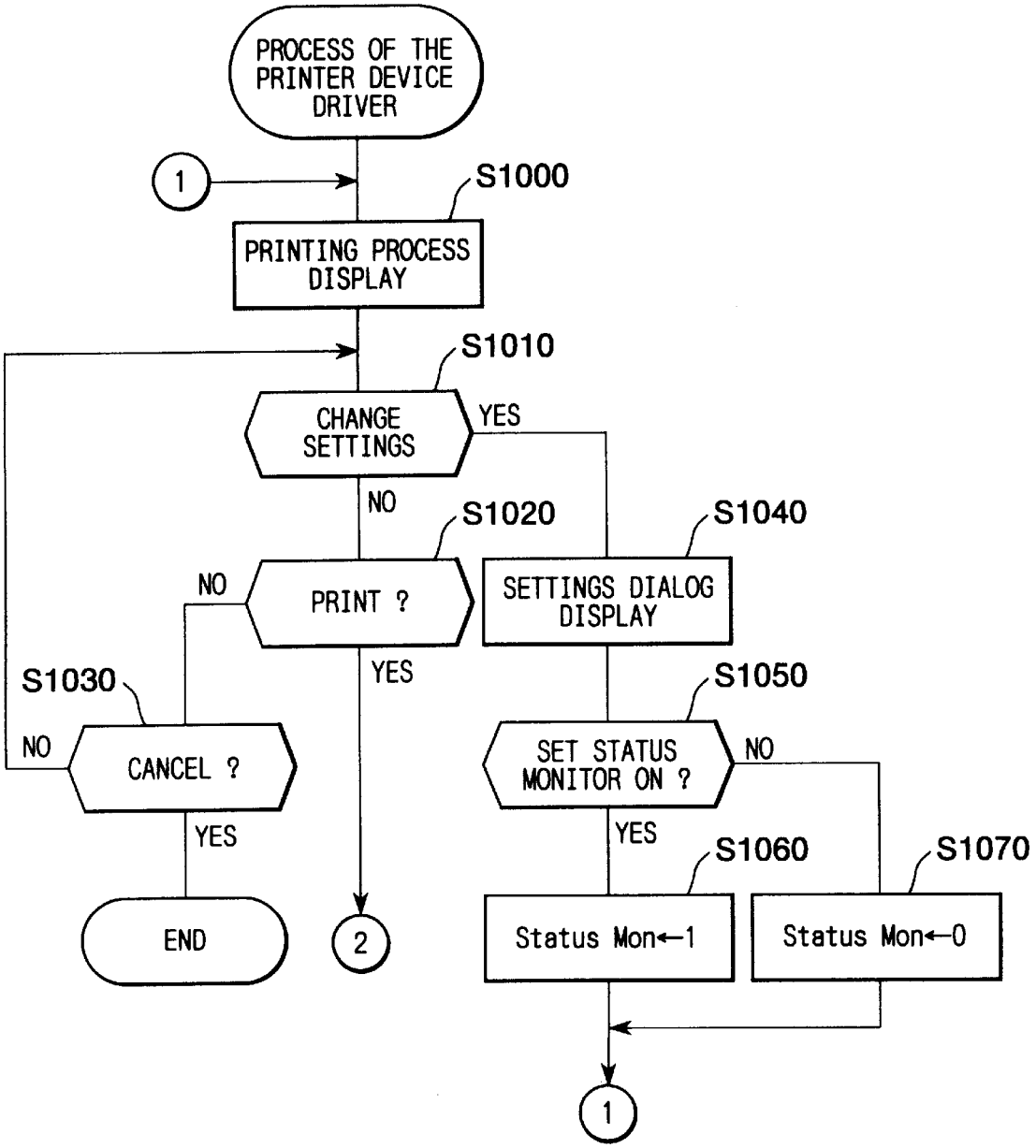
FIG. 3 is a flowchart showing a part of the process for a printer device driver of the first embodiment.
Figure 4:
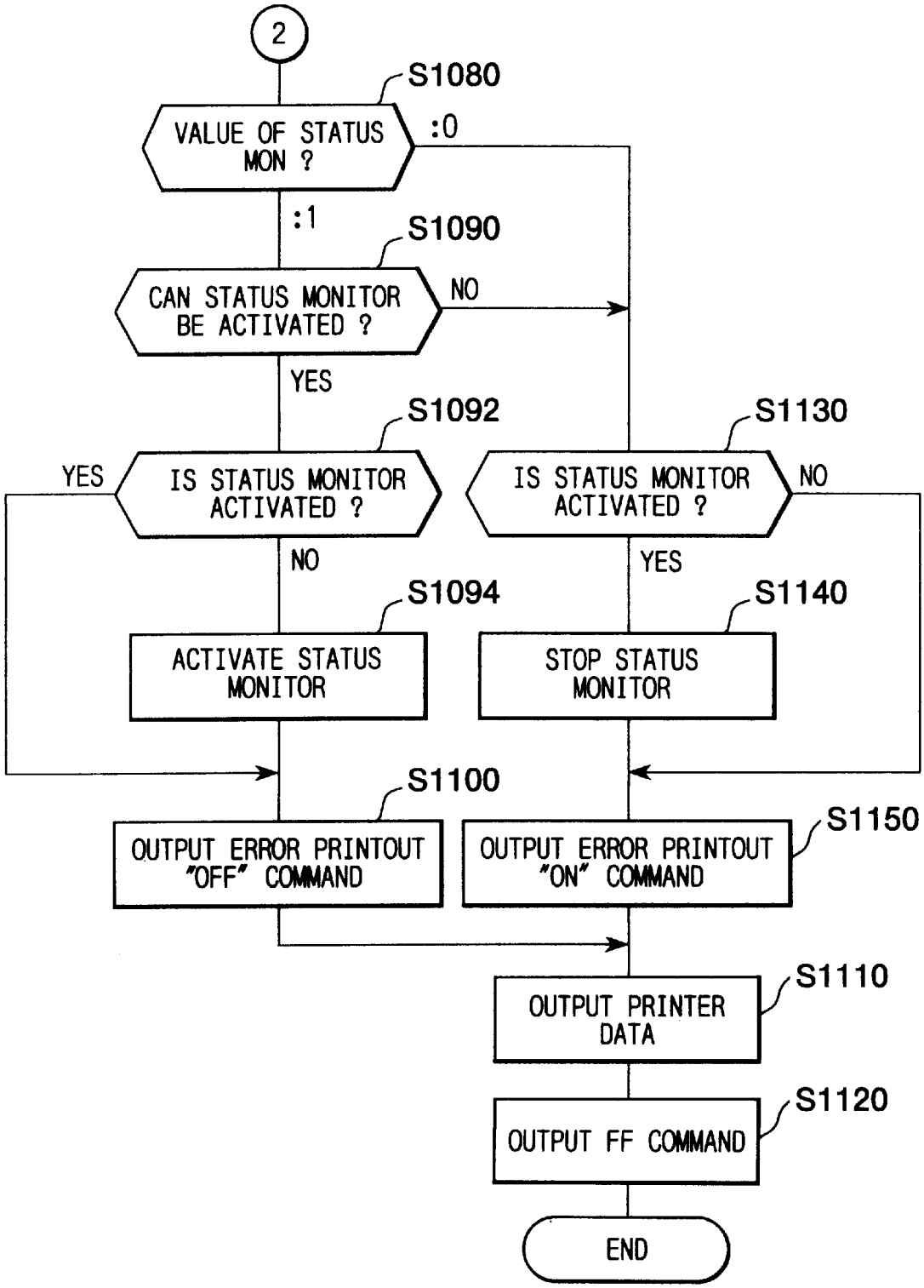
FIG. 4 is a flowchart showing a remaining part of the process for the printer device driver of the first embodiment.

The printer driver program PD is designed as shown in FIGS. 3 and 4. The printer driver program PD has been recorded in a printer driver storage medium such as a floppy disk, a CD-ROM, or a magnetooptic disk. When this program is installed into the computer 4, the program is retrieved from the auxiliary storage media and stored in the auxiliary storage unit 30.

Similarly, the status monitor program SP has been recorded in a status monitor program storage medium such as a floppy disk, a CD-ROM, or a magnetooptic disk. When this program is installed into the computer 4, the program is also retrieved from the auxiliary storage media and stored in the auxiliary storage unit 30. As will be described later, the status monitor program SP is activated by a running printer device driver PD when required, and is for controlling the display 32 to display a status monitor indicative of the status of the printer 2. It is noted that a problem application program list has also been stored in the status monitor program storage medium along with the status monitor program SP. The problem application program list is a file containing the names or codes of problem-inducing application programs that will cause conflicts when being executed simultaneously when the status monitor program SP is executed to control the display 32 to display a status monitor, resulting in hang ups or forced termination of the application program or of a printer device driver that activates the status monitor program. When the status monitor program SP is installed in the auxiliary storage unit 30, the file is also retrieved from the storage medium and stored in the auxiliary storage unit 30 together with the status monitor program SP. When the operating system OS is activated, the file is loaded into the RAM 28.

It is now assumed that a program of the operating system OS, a plurality of application programs, the printer driver program PD. and the status monitor program SP are retrieved from the storage media and installed in the auxiliary storage unit 30. When each program is executed, the program is loaded from the storage unit 30 into the RAM 28 and is executed by the CPU 24 in a time-divisional manner. That is, when the computer 4 is turned on, the program of the operating system OS is first loaded from the storage unit 30 into the RAM 28. Thus, the operating system program is activated. After the operating system is thus started, when the user selects one or more application programs, the selected application programs are further loaded from the storage unit 30 into the RAM 28. Thus, those programs are also activated to run. That is, those programs are also executed by the CPU 24 in a time-divisional manner. The display 32 is used commonly by the thus running application programs in the operating system OS because the operating system OS is capable of handling simultaneous execution of a plurality of application programs.

It is assumed that while the one or more application programs are thus running, the user operates one application program AP (such as a word processor or graphics-related program) to select a printing operation. As a result, the printer device driver PD is activated by commands issued from the application program AP. In more concrete terms, when receiving the printing instruction from the operator, the application program AP requests printing operation to the operating system OS, whereupon the operating system Os issues a start instruction to the printer device driver (device driver) PD. As a result, the printer device driver PD is activated. In other words, the printer driver PD is loaded from the storage unit 30 into the RAM 28. Thus, the printer driver PD starts running. That is, the printer device driver PD is executed by the CPU 24 together with the already-executed programs in a time-divisional manner.

As will be described later, when the printer device driver PD is thus running, the status monitor program SP, which is designed independent from the printer device driver PD, is activated by the printer device driver PD when the computer 4 is in a status monitor "on" mode and when the status monitor program SP can be executed. When the status monitor program SP is activated, the computer 4 displays a status monitor 32*a* indicative of the status of the printer 2. The computer 4 repeatedly performs a status monitor display process of FIG. 10 at a fixed time interval (one second, for example). During the status monitor display process, the computer 4 requests the printer 2 to transfer, to the computer 4, status data indicative of the present status of the printer 2. When the status data is received from the printer 2, the computer 4 analyzes the status data and displays the status of the laser printer 2 as text data in the status monitor display area 32*a* on the display 32.

It is noted that depending on the application program AP that has instructed the printer device driver PD, occasionally the personal computer 4 will hang up or the application program AP or the printer device driver PD will be forcibly terminated when the status monitor program SP is executed to display the status monitor 32*a*. For this reason, various application programs have been tested in advance to determine which can be executed simultaneously with the status monitor program SP, and the list of application programs that conflict with the status monitor program SP is prepared. As described already, the problem application program list has been stored in the status monitor program storage medium and loaded in the auxiliary storage unit 30.

Next, the printer device driver process attained by the printer device driver PD will be described with reference to FIGS. 3 and 4.

When the printer device driver PD is activated as described above, a display for the printing process first appears on the display 32 in S1000. This display contains buttons "OK," "Cancel," and "Options." The user chooses one of the selections by moving the mouse unit 38, causing the mouse cursor on the display 32 to move to the desired selection, and clicking the mouse button.

It is noted that the display button "Options" indicates the present setting mode of the computer 4. It is now assumed that the computer 4 is presently set in a status monitor "off" mode, wherein the status monitor, used for displaying the status of the laser printer 2, is not set to be displayed, that is the status monitor is set to "off." It is further assumed that the user wishes to change the setting to a status monitor "on" mode in order to view the status monitor. In this case, the user moves the mouse cursor to the "Options" button and clicks the mouse button, executing a setting process ("yes" in S1010). As a result, a dialog display for setting options is displayed in S1040. whereby various options can be selected. In this example, the user moves the mouse cursor to a "Status Monitor On/Off" button appearing on the option setting dialog display and clicks the mouse button to turn ON the status monitor setting. Then, the user clicks an "OK" button appearing on the option setting dialog display with the mouse ("yes" in S1050), causing a flag called StatusMon, set in the RAM 28 to indicate whether the status monitor mode is on or off, to be set to "1" in S1060. It is noted that when the status monitor is left in the off position, or is initially set to on and then changed to off, the StatusMon flag is set to "0" in S1070.

The process then returns to S1000 where the printing process display is displayed again. When the "Cancel" button is clicked in the printing process display in S1000, the process of the printer device driver PD is ended ("yes" in S1030). The personal computer 4 resumes the process of the application program AP that has instructed the printer device driver process.

If the user clicks on the "OK" button in the printing process display in S1000, on the other hand, the program proceeds via S1020 ("yes") to S1080 where the present setting status of the StatusMon flag is detected. When the StatusMon flag has been set to "1" before this process is begun or is now set to "1" on the above-described option setting dialog display, the program proceeds to S1090 where it is judged whether or not the status monitor program SP can be executed to display the status monitor. This is because as described already, depending on the application program AP that has instructed the printer device driver PD, occasionally the personal computer 4 will hang up or the application program AP or the printer device driver PD will be forcibly terminated when the status monitor program SP is executed. For this reason, in S1090, it is judged whether or not the name or code of the application program AP that has started the device driver PD exists in the problem application list.

If the application program AP is not in the above described list, because the status monitor can be displayed ("yes" in S1090), a check is performed in S1092 to determine whether the status monitor program SP is already being activated. If the status monitor program SP is not activated ("no" in S1092), the status monitor program SP is activated in S1094; if already activated ("yes" in S1092), S1094 is skipped. Next, an error print output "off" command is transmitted to the laser printer 2 in S1100. Print data is then transmitted from the application program AP to the laser printer 2 in S1110. Lastly, a form feed (FF) command, indicative of an end of data transmission, is outputted to the laser printer 2 in S1120.

On the other hand, when the StatusMon flag is detected to be "0" in S1080 or when it is determined that the status monitor may not be displayed ("no" in S1090), a check is performed to determine whether the status monitor program SP is already being activated in S1130. When the status monitor program SP is already being activated ("yes" in S1130), the status monitor program SP is terminated in S1140; if not being activated ("no" in S1130), S1140 is skipped. Next, an error print output "on" command is transmitted to the laser printer 2 in S1150. Print data is then transmitted from the application program AP to the laser printer 2 in S1110. Lastly, an FF command is outputted to the laser printer 2 in S1120.

Figure 6:
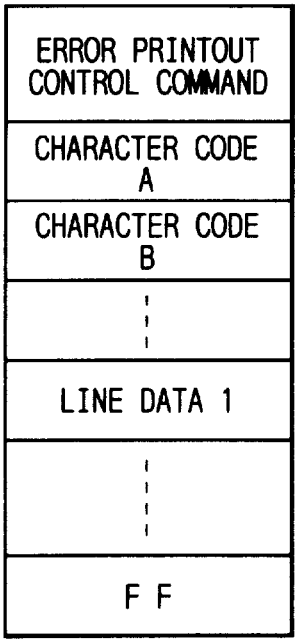
FIG. 6 is an explanatory diagram showing the data structure transmitted from the personal computer to the laser printer of the first embodiment.

As a result of the above-described process, commands and data are transmitted to the laser printer 2 as shown in FIG. 6.

FIG. 5 shows processes achieved by the laser printer 2 after the power of the laser printer 2 is turned on. First, various variable flags and mechanisms are initialized in S2000. Next, ErrPrntEna, a flag enabling the error print output function, is set to a default value of "1" in S2010. Other necessary processes are performed in S2020. When the printer 2 is set to a printing mode, the laser printer 2 waits for a signal to be sent from the personal computer 4.

When the signal is received, the laser printer 2 reads one byte in S2030.

Next, the contents of this one byte of data are determined in S2040–S2070. Assuming that the commands and data are transmitted from the personal computer 4 in the order shown in FIG. 6, the first byte of data is not the FF command indicating the end of the data transmission ("no" in S2040). Next, the laser printer 2 determines whether the data is an error print output control command in S2050. The error print output control command is either one of the error print output "on" command and the error print output "off" command transmitted from the personal computer 4 to the laser printer 2 in S1150 and S1100, respectively, of FIG. 4.

In the example of FIG. 6, the first byte of data received from the personal computer 4 is an error print output control command ( "yes" in S2050). Next, the printer determines in S2080 whether the command is an error print output "on" command. When the command is an error print output "on" command ("yes" in S2080), then the error print output enable flag ErrPrntEna is set to "1" in S2090, and the process is repeated from S2030. in which another byte of data is read. When the command is an error print output "off" command ("no" in S2080), on the other hand, the error print output enable flag ErrPrntEna is set to "0" in S2100, and the process is repeated from S2030, in which another byte of data is read.

The next byte of data, as shown in FIG. 6, is a printing character code ("no" in S2040; "no" in S2050; "yes" in S2060). Thus, data reception and other processes are performed in S2110. Hereafter, all data such as printing character codes and line data, and all other commands, except for the FF command, are processed in S2110.

If the byte of data received is not any of the printing character codes, line data, and commands ("no" in S2040–S2060), then the data is assumed to be an error. In this case, the present state or value of the error print output enable flag ErrPrintEna is judged in S2070. When the flag has been set to "1" in S2090 ("yes" in S2070), then an error message, including the fact that error data has been received and the contents of the data received, is printed out in S2120 by the printing functions of the laser printer 2. However, when the flag has been set to "0" in S2100 ("no" in S2070), then the error message is not printed out on paper. The process is repeated from S2030, in which another byte of data is read.

Figure 9:
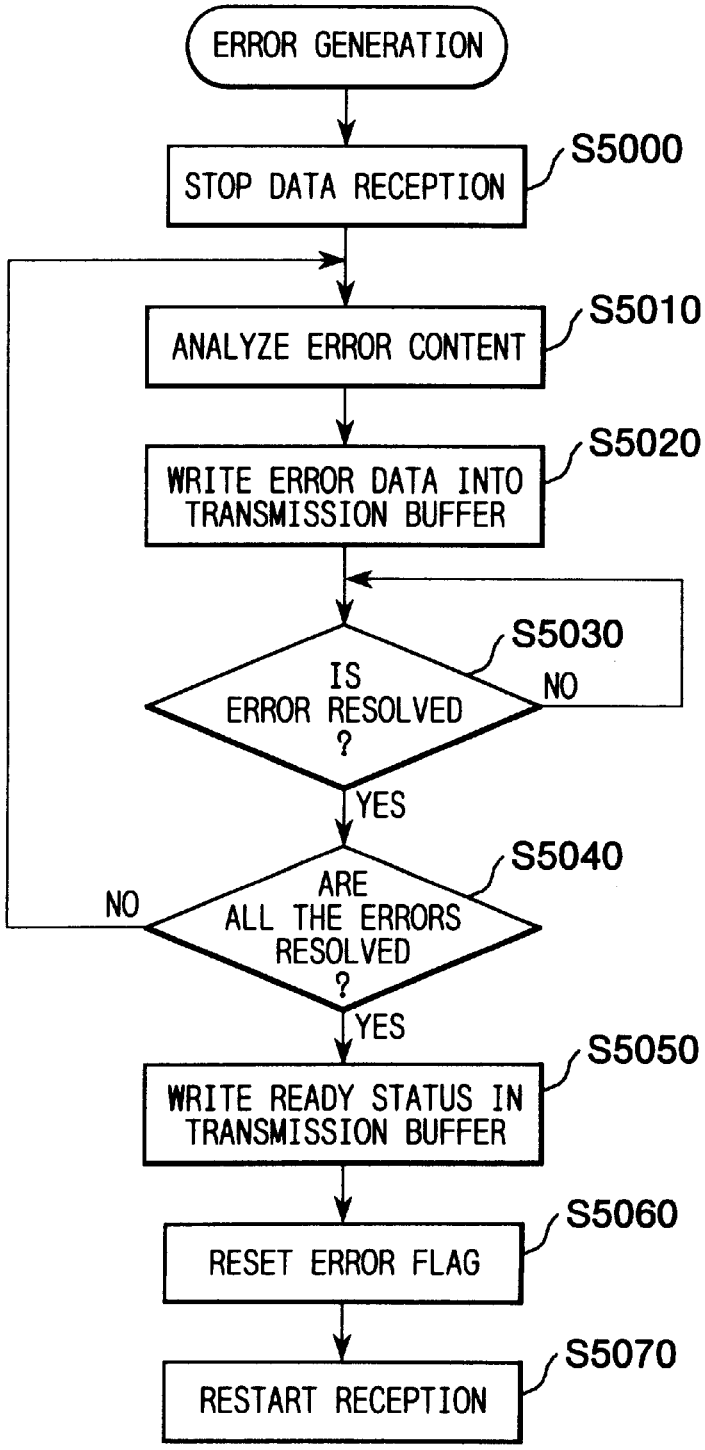
FIG. 9 is a flowchart showing an error interrupt process performed by the laser printer.

When the error occurs as described above and also when an error occurs in the laser printer 2, an error flag is set, and an error interrupt process is executed in the laser printer 2. When the error interrupt process is started, as shown in FIG. 9, the engine 20 is first brought into an inactive condition in S5000, thereby stopping the data reception operation. Then, the error content is analyzed in S5010. Data, indicative of the error content, is written in S5020 into a predetermined status storage area (transmission buffer) established in the RAM 16 of the laser printer 2. When the error is resolved ("yes" in S5030), it is judged in S5040 whether or not all the errors are resolved. When another error is occurred or when there exists any remaining errors not yet resolved ("no" in S5040), the not-yet resolved errors are analyzed, data thereof is stored, and then the errors are resolved through the processes of S5010–S5040. When all the errors are resolved ("yes" in S5040), data indicating a normal status is written to the status storage area (transmission buffer) in S5050. Then, the error flag is reset in S5060, and the engine 20 is brought into an active condition in S5070. Then, the error interrupt process is ended. The data reception operation of FIG. 5 is started again.

When the status monitor program SP is started up in the personal computer 4 and the status monitor program SP requests the laser printer 2 to transmit status data to the computer 4, an interrupt process (not shown) is executed in the laser printer 2 to send, as status data, data (error status data and normal status data) stored in the status storage area (transmission buffer) to the personal computer 4.

When all the printing data is received in order, the last byte of data received is an FF command ("yes" in S2040). When this command is received, the process to print the received data is executed in S2130. In other words, an image is formed on printing paper, and the printed paper is deposited in the receiving tray 2*c*.

After the printing process is ended, it is determined in S2140 whether an error has occurred during the process. When no error has occurred during the process ("no" in S2140), the process is repeated from S2030, in which the next data transmission is waited. When an error has occurred during the process ("yes" in S2140), on the other hand, the present value or state of the error print output enable flag ErrPrntEna is judged in S2150. When the flag has been set to "1" in S2090 ("yes" in S2150), the contents of the error, including the fact that the printing process has not been completed and the type of error, are printed out on paper by the printing functions of the laser printer 2 in S2160, and the process is repeated from S2030. However, when the flag has been set to "0" in S2100 ("no" in S2150), the contents of the error are not printed out by the laser printer 2. and the process is repeated from S2030.

Figure 10:
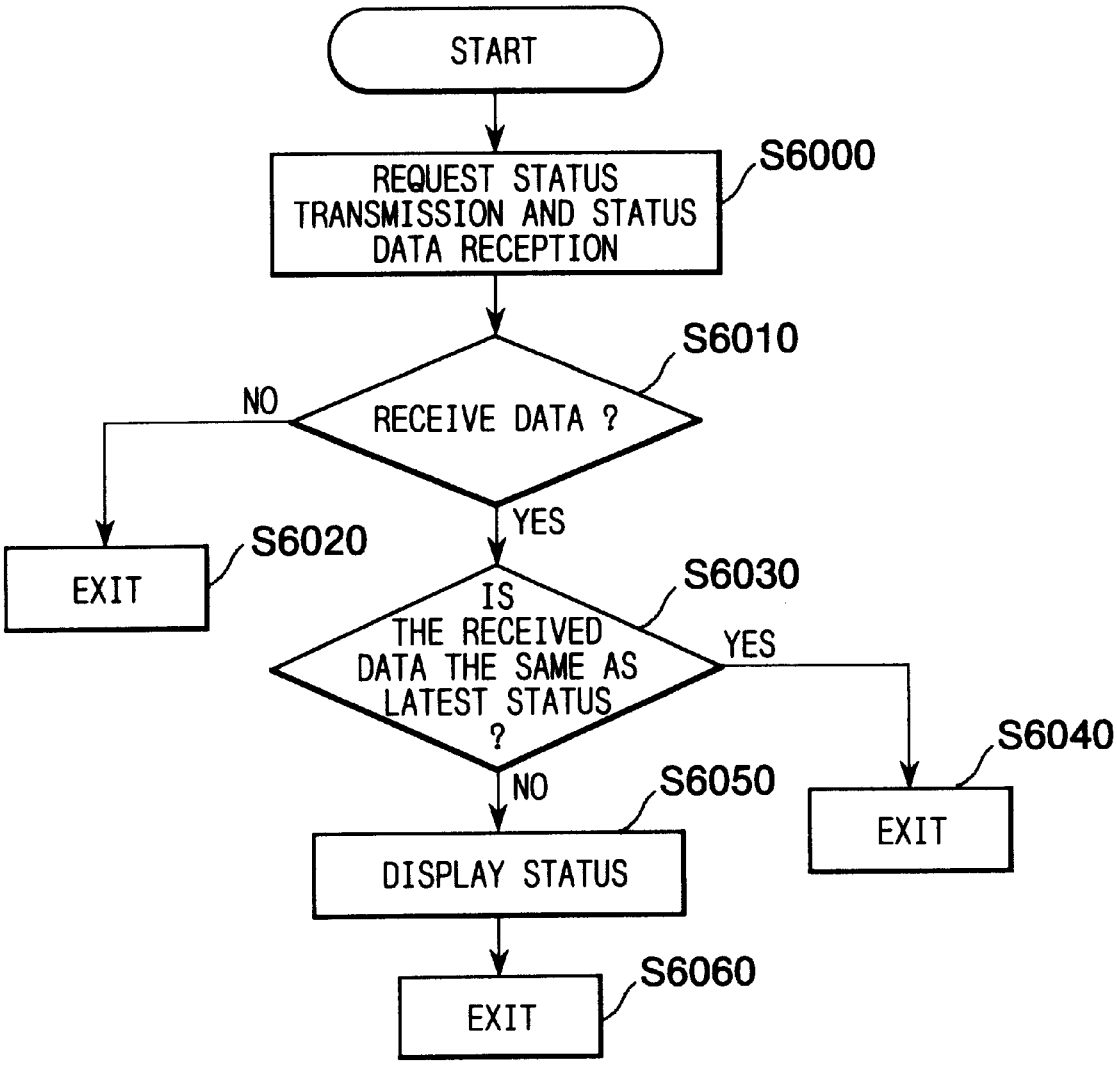
FIG. 10 is a flowchart showing a status monitor display process performed by the computer.

It is noted that when the status monitor program SP is executed by the computer 4 during this printing process due to the process of S1094 in FIG. 4, the computer 4 displays the status monitor 32*a* while repeatedly performing the status monitor display routine of FIG. 10 at the fixed time interval (one second, for example). During the status monitor display routine, the computer 4 first requests the laser printer 2 in S6000 to transmit status data to the computer 4. Upon receipt of the request, the laser printer 2 transmits status data to the personal computer 4. When no data is received at the computer 4 ("no" in S6010), the status monitor display routine is ended in S6020 without changing the content of the present status monitor 32*a*. When status data is received ("yes" in S6010), on the other hand, it is judged in S6030 whether or not the status represented by the received status data is the same as that of the latest received status data. When the present status is the same as the latest status ("yes" in S6030), the status monitor display routine ends in S6040 without changing the content of the display 32*a*. When the present status is different from the latest status ("no" in S6030), on the other hand, the status monitor display routine ends in S6060 after changing the content of the display 32*a* into the present status in S6050. The computer 4 thus continuously displays the present status of the laser printer 2 in the status monitor display area 32*a* on the display 32. The computer can therefore display various states of the printer 2. For example, the computer can display that the printer is in a warming-up condition, in a ready condition, in an operating condition, in an error condition such as a paper jam, a paper empty, a command error, or the like, and in other various conditions.

As described above, the personal computer 4, which is the data processing device of the present embodiment, receives status signals from the laser printer 2, which is the printing device of the present embodiment. When the StatusMon flag is set to "1," indicating that the status of the laser printer 2 is to be displayed in the status monitor on the display 32 of the personal computer 4, the personal computer 4 outputs in S1100, to the laser printer 2, an error print output "off" command instructing the printer not to perform error print outputs. When the StatusMon flag is set to "0," indicating that the status of the laser printer 2 is not to be displayed in the status monitor, on the other hand, the personal computer 4 outputs in S1150, to the laser printer 2, an error print output "on" command instructing the printer to perform error print outputs.

Thus, when the personal computer 4 is set to display the status of the laser printer 2, without any action on the part of the user, the personal computer 4 automatically sends an error print output "off" command to the laser printer 2. Therefore, if a printer error occurs, an error message is not outputted onto printing paper and printing paper is not wasted. Further, printing settings need not be changed, improving work efficiency.

When the personal computer 4 is set not to display the status of the laser printer 2, on the other hand, the personal computer 4 automatically sends an error print output "on" command to the laser printer 2. Therefore, even if the personal computer 4 does not display the status monitor, error conditions in the laser printer 2 can still be determined and quickly resolved, preventing a decrease in work efficiency.

As described above, according to the first embodiment of the present invention, it is judged in S1080 whether or not the status monitor is to be displayed on the display of the personal computer. If the status monitor is to be displayed on the personal computer, the error print output "off" command is transmitted in S1100 to the printer 2. Therefore, when a printing error occurs, an error message is displayed on the computer display and not printed out by the printer. Thus, excessive waste of paper can be prevented.

A second embodiment will be described below with reference to FIG. 7.

Figure 7:
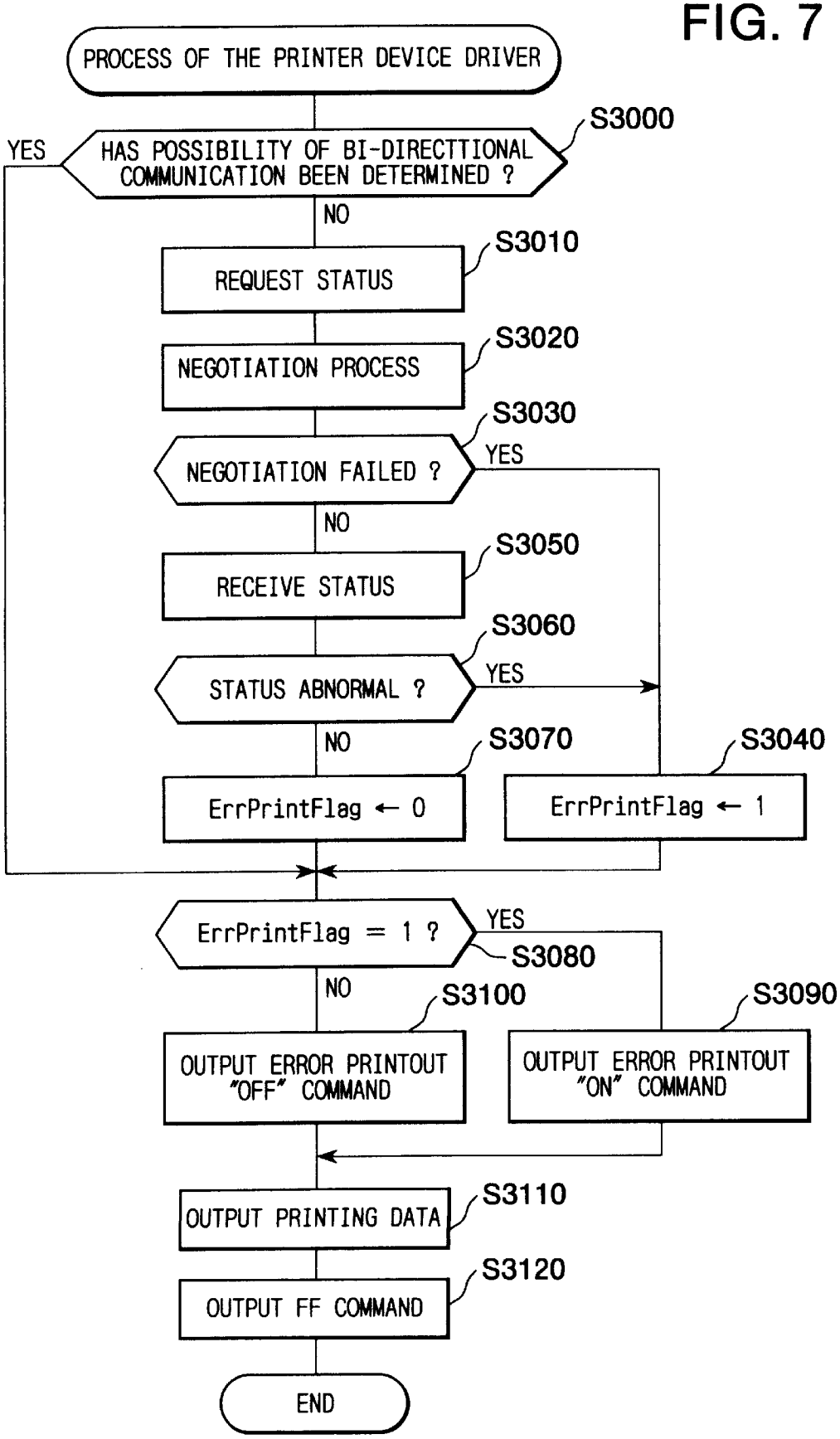
FIG. 7 is a flowchart showing the process of the printer device driver performed in the personal computer of the second embodiment.

The process of the printer device driver PD of the second embodiment is shown in the flowchart of FIG. 7. Except for this process, all other structures and processes are exactly the same as the structures and processes described in the first embodiment. That is, the printer 2 performs the process of FIG. 5 also in the present embodiment. The error interrupt process performed by the printer 2 and the status monitor display process performed by the computer 4 are the same as those shown in FIGS. 9 and 10. respectively.

When the process shown in FIG. 7 of the printer driver PD is instructed by a certain application program AP, it is first judged in S3000 whether or not the possibility of bi-directional communication between the personal computer 4 and the laser printer 2 has been detected to be determined. For example, when ErrPrintFlag, a flag described below, is set to a value other than "0" or "1," such as "−1," the possibility of bi-directional communication has not yet been determined ("no" in S3000). Therefore, a status request is sent to the laser printer 2 by setting a specified line (select in) of the cable 10 to a high level "High" in S3010. Immediately, a negotiation process is executed in S3020. That is, a series of communication exchanges are performed to achieve bi-directional communication between the computer 4 and the printer 2.

When the negotiation process is completed, it is judged in S3030 whether the negotiation process has been performed successfully. If the series of communication exchanges have been performed unsuccessfully ("yes" in S3030), the error print output enable flag ErrPrintFlag is set to "1" in S3040 to indicate that bi-directional communication not possible between the printer 2 and the computer 4. If the negotiation process has been performed successfully ("no" in S3030), on the other hand, it is tentatively assumed that bi-directional communication is possible. The computer 4 then receives status signals transmitted from the laser printer 2 in S3050. Status data acquired from the status signals is then analyzed for abnormalities in S3060. In other words, the format of the status data is analyzed to determine whether it conforms to a format predetermined for status data. When the data does not conform to the predetermined format, the data is assumed to be abnormal ("yes" in S3060), and the flag ErrPrintFlag is set to "1" in S3040 to indicate that bi-directional communication is not possible between the printer 2 and the computer 4. When the data does conform to the predetermined format ("no" in S3060), the flag ErrPrintFlag is set to "0" in S3070 to indicate that bi-directional communication is possible.

Next, the present value of the flag ErrPrintFlag is detected in S3080. If the value of the flag is "1" ("yes" in S3080), an error print output "on" command is outputted to the laser printer 2 in S3090. If the value of the flag is "0 ". (S3080: no), on the other hand, an error print output "off" command is outputted to the laser printer 2 in S3100.

Print data is then sent from the application program AP to the laser printer 2 in S3110, after which an FF command is outputted to the laser printer 2 in S3120.

It is noted that when this process is started again, the result of S3000 will be "yes," since the possibility of bi-directional communication has been determined during the above-described process. Therefore, S3010–S3070 need not be repeated, and the process skips to S3080.

Processes are executed in the laser printer 2 in the same manner as in the first embodiment according to: commands for the error print output which are transmitted from the computer 4 during the processes of S3090 and S3100, print data which are transmitted from the computer 4 during the processes of S3110, and the FF command which is transmitted from the computer 4 during the processes of S3120.

As described above, according to the second embodiment, the personal computer 4 outputs an error print output "on" command to the laser printer 2 in S3090 when the personal computer 4 determines that status signals cannot be received from the laser printer 2 through performing the negotiation process of S3020 ("yes" in S3030) or when the status signals transmitted from the printer 2 are abnormal ("yes" in S3060).

The status monitor cannot be displayed by the personal computer 4 when bi-directional communication is not possible between the personal computer 4 and the laser printer 2. This is because the personal computer 4 cannot receive status signals from the laser printer 2, or the format of the received status signals do not conform to a valid format. In such cases, the personal computer 4 automatically outputs an error print output "on" command to the laser printer 2. This mode allows the printer to output error messages. When an error occurs in the laser printer 2, the printer outputs an error print output on printing paper. Thus, error conditions in the laser printer 2 can still be determined and quickly resolved, preventing a decrease in work efficiency.

It is also possible for the process of FIG. 3 to be executed before the process of the printer device driver of FIG. 7 is started.

As described above, in the second embodiment, the status request command is transmitted to the printer 2 in S3010; the status signal is judged in S3030 and S3060; and the error print output setting is performed in S3040, S3070, S3080, and S3090.

Next, a third embodiment of the present invention will be described with reference to FIG. 8.

According to the present embodiment, the computer 4 performs the processes the same as the process of FIG. 7 except that S3000, S3020. S3030, and S3060–S3100 are omitted. That is, the computer 4 performs only the steps S3010, S3050, S3110, and S3120. The printer 2 performs the process of FIG. 5, and also performs an interrupt process shown in FIG. 8 when the specified line (select in) of the cable 10 is set to the high level "High" in S3010 of FIG. 7. Except for the above, all other structures and processes are the same as the structures and processes described in the second embodiment. That is, the error interrupt process performed by the printer 2 and the status monitor display process performed by the computer 4 are the same as those shown in FIGS. 9 and 10, respectively.

Figure 8:
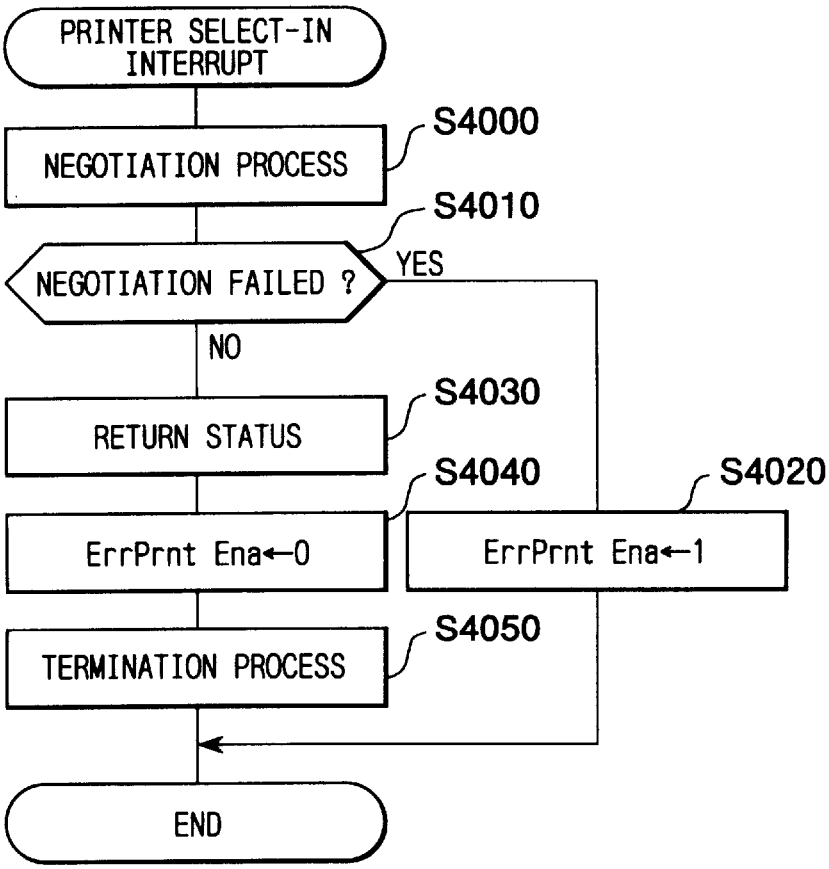
FIG. 8 is a flowchart showing a select-in interrupt process performed in the laser printer of the third embodiment.

During the interrupt process of FIG. 8, the negotiation process is first executed in S4000, in which the series of communication exchanges are performed between the personal computer 4 and the laser printer 2. When the negotiation process has not been performed successfully ("yes" in S4010), the error print output enable flag ErrPrntEna is set to "1" in S4020, and the process ends. Accordingly, in the process of FIG. 5, an affirmative judgment will be performed in each of the steps of S2070 and S2150, and error print outputs will be executed in S2120 and S2160. respectively. Because the default value "1" for the error print output enable flag is initially set in S2010, even if this interrupt process is never executed, error print outputs will be executed in S2120 and S2160.

On the other hand, when the negotiation process has been performed successfully ("no" in S4010), the printer 2 transmits a status signal to the personal computer 4 in S4030, and then sets the error print output enable flag ErrPrntEna to "0" in S4040. Next, a termination process to end the bi-directional communication is executed in S4050, and the interrupt process ends. In this case, a negative judgment will be performed in each of S2070 and S2150 in the processes of FIG. 5, and therefore error print outputs will not be executed. However, because bi-directional communication is possible, the status monitor program SP will be started up and the status signals transmitted from the laser printer 2 will be read and displayed in the status monitor on the display 32 of the personal computer 4.

Thus, when bidirectional communication is successfully performed between the personal computer 4 and the laser printer 2 ("no" in S4010), the laser printer 2 performs a setting to prevent the execution of error print outputs. The printer 2 stores, in the RAM 16, data indicating that bi-directional communication is possible. The personal computer 4 then receives status signals from the laser printer 2 and displays the printer status on the display 32. Hence, the laser printer 2 sets itself not to execute error print outputs, thereby not wasting printing paper nor preventing a decline in work efficiency.

On the other hand, when bi-directional communication between the personal computer 4 and laser printer 2 is unsuccessful ("yes" in S4010), the error print output enable flag ErrPrntEna is set to "1" in S4020. Also, when bidirectional communication has not yet been attempted, the flag ErrPrntEna will remain as its default value of "1" which is set in S2010 of the process of FIG. 5. In either case, because ErrPrntEna is thus set to "1," the status of the laser printer 2 will not be displayed by the personal computer 4. However, the laser printer 2 will automatically be set to execute error print outputs on printing paper when a printing error occurs, thereby enabling the user to immediately learn of error conditions in the laser printer 2 and to quickly resolve such error conditions to avoid a decline in work efficiency.

As described above, according to the third embodiment, it is judged in S4010 whether the bi-directional communication is executed properly, and the process of the error print output setting is performed in S4020 and S4040.

While the invention has been described in detail with reference to the specific embodiments thereof, it would be apparent to those skilled in the art that various changes and modifications may be made therein without departing from the spirit of the invention.

For example, in the third embodiment, the printer 2 sends the status signal in response to the status request transmitted from the computer 4. Then, the printer 2 sets the flag "ErrPrnt Ena" to zero (0). However, the printer 2 may send a status signal to the computer 2 even when the printer 2 does not receive the request from the computer 4. For example, the printer 2 can send status signals to the computer 4 even when the printer 2 does not receive the status request when the printer 2 and the computer 4 are designed to perform communication according to RS-232C or IEEE 1394 standard. Also in this case, the printer 2 may set the flag "ErrPrnt Ena" to zero (0). The printer 2 can thus judge whether or not the printer 2 is in a condition capable of sending the status signals to the computer 4 through judging whether or not the printer 2 has sent the status signals. Then, the printer 2 may set the flag "ErrPrnt Ena" to zero (0) or one (1).

In the second embodiment, the personal computer 4 requests the laser printer 2 in S3010 to send status signals during the bi-directional communication, and then the personal computer 4 outputs, to the printer 2, commands to or not to execute error print output operation in S3090 or S3100. However, the personal computer 4 may output, to the laser printer 2, a command to instruct the printer 2 to or not to execute error print outputs, after communication has been established between the computer 4 and the printer 2 and the personal computer 4 receives from the laser printer 2 a code identifying the laser printer 2. In other words, the processes of S3010–S3070 of FIG. 7 may be replaced with a process of receiving a printer ID after a connection with the laser printer 2 has been established. That is, a request for the printer ID is sent to the laser printer 2 in S3010; the printer ID is received from the laser printer 2 in S3050; and whether the ID is received and the validity of the received ID is determined in S3060.

It is now assumed that the operating system OS used in the personal computer 4 is a multi-tasking operating system OS such as an operating system product from Microsoft Corporation, such as Windows 95 or Windows NT. When a device such as a printer is connected to the personal computer 4, the operating system OS automatically communicates with the device, requesting an identifying code from the device, such as the device name, ID, and the like. If the laser printer 2 transmits a code in response to this request, it is determined that bi-directional communication is possible between the computer and printer. Accordingly, the personal computer 4 can receive status signals from the laser printer 2 and display the status on the display 32. Accordingly, if an ID and the like are thus received, it is determined that bidirectional communication is possible. Therefore, the personal computer 4 can prevent the laser printer 2 from executing error print outputs by outputting an error print output "off" command to the laser printer 2. thereby preventing a waste of printing paper and a decline in work efficiency. Thus, according to this modification, the identifying code reception judgment is performed in S3060; and the error print output setting is performed in S3070.

According to another modification, the laser printer 2 is modified to set itself so as not to execute error print outputs after transmitting the device identification code, such as a device name, ID, and the like. For example, in the process shown in FIG. 8. S4030 can be modified to send an ID and the like of the laser printer 2 in response to a request transmitted from the personal computer 4. In this modification, the identifying code reception judgment is performed in S4010; and the error print output setting is performed in S4040.

In the above description, each of the above-described processes performed in the personal computer 4 is achieved in software. Each execution program is initially stored on a storage medium such as a floppy disk, magneto-optic disk, or CD-ROM, installed from that storage medium onto the auxiliary storage unit 30 in the computer 4, and then loaded into the RAM 28 when the program is to be executed. However, it is also possible to install or load each program into the personal computer 4 via a network.

Similarly, each of the processes performed in the printer 2 is achieved in software. Each execution program may therefore be initially stored on a storage medium such as a floppy disk, magneto-optic disk, or CD-ROM, and installed from that storage medium into a ROM such as an extension ROM provided in the printer 2.

As described above, according to the first embodiment, the data processing device 4 outputs, to the printing device 2, a command instructing the printing device not to execute error print outputs when the data processing device is set to display the printer status on the display 32. Thus, without any action on the part of the user, when the data processing device 4 is set to display the printer status, the printing device 2 does not output an error print output on printing paper when a printing error occurs. Therefore, printing paper is not wasted. Further, printing settings need not be changed, improving work efficiency.

According to the second embodiment, the data processing device 4 outputs a command to the printing device to execute error print outputs when the data processing device cannot receive status signals from the printing device or the status signals received are abnormal even when the data processing device can receive the status signals. Thus, when the data processing device 4 cannot display the printer status due to the problems described above, without any action on the part of the user, the data processing device 4 automatically outputs, to the printing device, a command to execute error print outputs. Therefore, when a printing error occurs, the error message is printed on printing paper because the data processing device cannot display the message. In this way, the user is still informed of the problem and need not waste time in determining and solving the problem.

According to the third embodiment, the printing device 2 itself performs a setting operation to prevent the execution of error print outputs after bi-directional communication is successfully performed with the data processing device. With this configuration, the printing device remembers that bi-directional communication has been successfully achieved with the data processing device. If bi-directional communication has been successfully achieved, the printing device automatically performs a setting operation to prevent execution of error print outputs, assuming that the data processing device will be able to receive status signals from the printing device and display the printing status on the display unit. Hence, printing paper is not wasted and work efficiency not decreased.

According to the modification, after establishing a connection with the printing device and after receiving signals identifying that printing device, the data processing device outputs, to the printing device, a command not to execute error print outputs. As described already, when various devices, such as a printing device, are connected to the data processing device, certain types of operating systems, loaded in the data processing device, require those devices to transmit signals containing the name and ID of the device to the data processing device. If the printing device transmits these identifying signals to the data processing device in response to a request from the data processing device, it is determined that bi-directional communication is possible and, therefore, that the data processing device can receive status signals from the printing device and display the printing status on the display unit. Accordingly, the data processing device outputs, to the printing device, commands instructing the printing device not to execute error print outputs, thereby preventing the waste of paper and a decline in work efficiency.

In contrast, according to the other modification, after a connection has been established between the data processing device and the printing device, the printing device performs a setting operation to prevent error print outputs, after transmitting identifying signals to the data processing device. In this way, the printing device itself can make the determination whether or not to output error print outputs.

What is claimed is:

1. A method of controlling a data processing device and a printing device, connected to each other, to perform a printing operation, the method comprising the steps of:

judging whether or not a data processing device, connected to a printing device, is capable of displaying a status monitor indicative of a status of the printing device;

setting the printing device into an error print output execution mode for performing an error print output operation when the data processing device is judged not to be capable of displaying the status monitor and setting the printing device into an error print output non-execution mode not for performing the error print output operation when the data processing device is judged to be capable of displaying the status monitor; and sending print data from the data processing device to the printing device, thereby controlling the printing device to perform printing operation.

2. A method as claimed in claim 1, wherein when the data processing device is capable of displaying the status monitor, the data processing device requests the printing device to send status signals, analyzes the status signals, and displays the analyzed status of the printing device on a display while the printing device performs printing operation, the printing device, set in the error print output non-execution mode, not producing an error print output when an error occurs.

3. A method as claimed in claim 2, wherein when the data processing device is not capable of displaying the status monitor, the printing device, set in the error print output execution mode, produces an error print output indicative of an error when the error occurs during the printing operation.

4. A method as claimed in claim 1, wherein the judgment step includes the step of controlling the data processing device to judge whether or not the data processing device is capable of displaying the status monitor, and wherein the setting step includes the step of controlling the data processing device to send, to the printing device, command data for setting the printing device into either one of the error print output execution mode and the error print output non-execution mode based on the judged result.

5. A method as claimed in claim 1, wherein the judgment step includes the step of judging whether or not the data processing device is in a status monitor setting mode to receive status signals from the printing device and to display the status monitor on a display, and wherein the setting step includes the step of setting the printing device into the error print output execution mode when the data processing device is judged to be not in the status monitor setting mode and setting the printing device into the error print output non-execution mode when the data processing device is judged to be in the status monitor setting mode.

6. A method as claimed in claim 1, wherein the judgment step includes the steps of:

controlling the data processing device to send, to the printing device, a status request command requesting the printing device to send a status signal indicative of the status of the printing device;

controlling the data processing device to determine whether or not a status signal is received from the printing device in response to the status request command; and controlling the data processing device to determine whether or not the received status signal is in a predetermined format when it is determined that a status signal is received from the printing device.

7. A method as claimed in claim 6, wherein the setting step includes the step of setting the printing device into the error print output execution mode when no status signal is received from the printing device and when the received status signal is not in the predetermined format and setting the printing device into the error print output non-execution mode when a status signal of the predetermined format is received from the printing device.

8. A method as claimed in claim 1, wherein the judgment step includes the step of detecting whether or not bi-directional communication can be performed between the data processing device and the printing device, and wherein the setting step includes the step of setting the printing device into the error print output non-execution mode when the bi-directional communication is detected to be capable of being performed and setting the printing device into the error print output execution mode when the bidirectional communication is detected not to be capable of being performed.

9. A method as claimed in claim 8, wherein the bi-directional communication detecting step includes the step of controlling the printing device to detect whether or not bi-directional communication can be performed between the data processing device and the printing device.

10. A method as claimed in claim 9, wherein the bi-directional communication detecting step includes the step of judging whether or not a code identifying the printing device is transmitted from the printing device to the data processing device after a connection is established between the data processing device and the printing device, and wherein the setting step includes the step of setting the printing device into the error print output non-execution mode when the printing device identifying code is transmitted and setting the printing device into the error print output execution mode when the printing device identifying code is not transmitted.

11. A method as claimed in claim 10, wherein the bi-directional communication detecting step includes the step of controlling the data processing device to judge whether or not the code identifying the printing device is received from the printing device after a connection is established between the data processing device and the printing device, and wherein the setting step includes the step of setting the printing device into the error print output non-execution mode when the printing device identifying code is received and setting the printing device into the error print output execution mode when the printing device identifying code is not received.

12. A method as claimed in claim 10, wherein the bi-directional communication detecting step includes the step of controlling the printing device to judge whether or not the code identifying the printing device is transmitted to the data processing device after a connection is established between the data processing device and the printing device, and wherein the setting step includes the step of setting the printing device into the error print output non-execution mode when the printing device identifying code is transmitted and setting the printing device into the error print output execution mode when the printing device identifying code is not transmitted.

13. A control device for controlling a printing device to perform a printing operation, the control device comprising:

means for displaying a status monitor indicative of a status of a printing device;

means for judging whether or not the displaying means is in a state capable of displaying the status monitor;

means for setting the printing device into an error print output execution mode for performing an error print output operation when the displaying means is judged not to be capable of displaying the status monitor and setting the printing device into an error print output non-execution mode not for performing the error print output operation when the displaying means is judged to be capable of displaying the status monitor; and means for sending print data to the printing device, thereby controlling the printing device to perform printing operation.

14. A control device as claimed in claim 13, wherein the displaying means includes:

request means for requesting the printing device to send status signals while the printing device performs printing operation;

analyzing means for analyzing the status signals; and monitor display means for displaying the analyzed status of the printing device on a display.

15. A control device as claimed in claim 14, wherein when the displaying means is in the state capable of displaying the status monitor, the printing device, set in the error print output non-execution mode, does not produce an error print output when an error occurs, and when the displaying means is in a state not capable of displaying the status monitor, the printing device, set in the error print output execution mode, produces an error print output indicative of an error when the error occurs during the printing operation.

16. A control device as claimed in claim 15, wherein the setting means includes means for sending, to the printing device, command data for setting the printing device into either one of the error print output execution mode and the error print output non-execution mode based on the result judged by the judging means.

17. A control device as claimed in claim 16, wherein the judgment means includes mode judging means for judging whether or not the displaying means is in a status monitor setting mode to receive status signals from the printing device and to display the status monitor, the command sending means sends the command data for setting the printing device into the error print output execution mode when the displaying means is judged to be not in the status monitor setting mode and sends the command data for setting the printing device into the error print output non-execution mode when the displaying means is judged to be in the status monitor setting mode.

18. A control device as claimed in claim 16, wherein the judgment means includes:

means for sending, to the printing device, a status request command requesting the printing device to send a status signal indicative of the status of the printing device;

means for determining whether or not a status signal is received from the printing device in response to the status request command; and means for judging whether or not the received status signal is in a predetermined format when it is determined that a status signal is received from the printing device.

19. A control device as claimed in claim 18, wherein the command sending means sends the command data for setting the printing device into the error print output execution mode when no status signal is received from the printing device and when the received status signal is not in the predetermined format and sends the command data for setting the printing device into the error print output non-execution mode when a status signal of the predetermined format is received from the printing device.

20. A control device as claimed in claim 16, wherein the judgment means includes means for detecting whether or not bi-directional communication can be performed between the data processing device and the printing device, and wherein the command sending means sends the command data for setting the printing device into the error print output non-execution mode when the bi-directional communication is detected to be capable of being performed and sends the command data for setting the printing device into the error print output execution mode when the bi-directional communication is detected not to be capable of being performed.

21. A control device as claimed in claim 20, wherein the bidirectional communication detecting means includes means for judging whether or not a code identifying the printing device is transmitted from the printing device after a connection is established between the data processing device and the printing device, and wherein the command sending means sends the command data for setting the printing device into the error print output non-execution mode when the printing device identifying code is transmitted and sends the command data for setting the printing device into the error print output execution mode when the printing device identifying code is not transmitted.

22. A printing device for performing a printing operation, the printing device comprising:

means for receiving print data from a data processing device and for performing a printing operation with the received print data;

means for performing an error print output operation to produce an error print output when an error occurs during the printing operation;

means for sending, to the data processing device, a status signal indicative of a status of the printing means;

means for judging whether or not the status signal sending means is in a state capable of sending the status signal to the data processing device; and means for setting the error print output means into an error print output execution mode for performing the error print output operation when the status signal sending means is judged not to be capable of sending the status signal and setting the error print output means into an error print output non-execution mode not for performing the error print output operation when the status signal sending means is judged to be capable of sending the status signal.

23. A printing device as claimed in claim 22, wherein when the error print output means is in the error print output non-execution mode, the error print output means does not produce an error print output when an error occurs, and when the error print output means is in the error print output execution mode, the error print output means produces an error print output indicative of an error when the error occurs during the printing operation.

24. A printing device as claimed in claim 23, wherein the judgment means includes detection means for detecting whether or not bi-directional communication can be performed between the printing device and the data processing device, the setting means setting the error print output means into the error print output execution mode when the bi-directional communication is detected not to be capable of being performed and setting the error print output means into the error print output non-execution mode when the bidirectional communication is detected to be capable of being performed.

25. A printing device as claimed in claim 23, further comprising code sending means for sending a code identifying the printing device to the data processing device after a connection is established between the data processing device and the printing device, the judgment means judging whether or not the code sending means sends the identifying code to the data processing device, the setting means setting the error print output means into the error print output execution mode when the code sending means does not send the identification code and setting the error print output means into the error print output non-execution mode when the code sending means sends the identification code.

26. A program storage medium for storing data of a program indicative of a process for controlling a data processing device to control a printing device to perform a printing operation, the program comprising:

a program of judging whether or not a data processing device, connected to a printing device, is capable of displaying a status monitor indicative of a status of the printing device;

a program of setting the printing device into an error print output execution mode for performing an error print output operation when the data processing device is judged not to be capable of displaying the status monitor and setting the printing device into an error print output non-execution mode not for performing the error print output operation when the data processing device is judged to be capable of displaying the status monitor; and a program of sending print data to the printing device, thereby controlling the printing device to perform printing operation.

27. A storage medium as claimed in claim 26, wherein the program further comprises:

a program of requesting, when the data processing device is judged to be capable of displaying the status monitor, the printing device to send status signals while the printing device performs printing operation;

a program of analyzing the status signals; and a program of displaying the analyzed status of the printing device on a display.

28. A storage medium as claimed in claim 26, wherein the setting program includes the program of sending, to the printing device, command data for setting the printing device into either one of the error print output execution mode and the error print output non-execution mode based on the judged result.

29. A method as claimed in claim 26, wherein the judgment program includes a program of judging whether or not the data processing device is in a status monitor setting mode to receive status signals from the printing device and to display the status monitor on a display, and wherein the setting program includes a program of setting the printing device into the error print output execution mode when the data processing device is judged to be not in the status monitor setting mode and setting the printing device into the error print output non-execution mode when the data processing device is judged to be in the status monitor setting mode.

30. A storage medium as claimed in claim 26, wherein the judgment program includes:

a program of sending, to the printing device, a status request command requesting the printing device to send a status signal indicative of the status of the printing device;

a program of determining whether or not a status signal is received from the printing device in response to the status request command; and a program of judging whether or not the received status signal is in a predetermined format when it is determined that a status signal is received from the printing device.

31. A storage medium as claimed in claim 30, wherein the setting program includes a program of setting the printing device into the error print output execution mode when no status signal is received from the printing device and when the received status signal is not in the predetermined format and setting the printing device into the error print output non-execution mode when a status signal of the predetermined format is received from the printing device.

32. A storage medium as claimed in claim 26, wherein the judgment program includes a program of detecting whether or not bi-directional communication can be performed between the data processing device and the printing device, and wherein the setting program includes a program of setting the printing device into the error print output non-execution mode when the bi-directional communication is detected to be capable of being performed and setting the printing device into the error print output execution mode when the bi-directional communication is detected not to be capable of being performed.

33. A storage medium as claimed in claim 32, wherein the bi-directional communication detecting program includes a program of judging whether or not a code identifying the printing device is transmitted from the printing device to the data processing device after a connection is established between the data processing device and the printing device, and wherein the setting program includes a program of setting the printing device into the error print output non-execution mode when the printing device identifying code is transmitted and setting the printing device into the error print output execution mode when the printing device identifying code is not transmitted.

34. A program storage medium for storing data of a program indicative of a process for controlling a printing device to perform a printing operation, the program comprising:

a program of judging whether or not a data processing device, connected to a printing device, is capable of displaying a status monitor indicative of a status of the printing device;

a program of setting the printing device into an error print output execution mode for performing an error print output operation when the data processing device is judged not to be capable of displaying the status monitor and setting the printing device into an error print output non-execution mode not for performing the error print output operation when the data processing device is judged to be capable of displaying the status monitor; and a program of performing printing operation with print data sent from the data processing device.

35. A storage medium as claimed in claim 34, further comprising a program of performing the error print output operation to produce an error print output when an error occurs during the printing operation when the printing device is set into the error print output execution mode.

36. A storage medium as claimed in claim 35, wherein the judgment program includes a program of detecting whether or not bi-directional communication can be performed between the printing device and the data processing device, the setting program setting the printing device into the error print output execution mode when the bi-directional communication is detected not to be capable of being performed and setting the printing device into the error print output non-execution mode when the bi-directional communication is detected to be capable of being performed.

37. A storage medium as claimed in claim 35, wherein the detecting program includes a program of trying to send a code identifying the printing device to the data processing device after a connection is established between the data processing device and the printing device, the judgment program judging whether or not the identifying code is sent to the data processing device, the setting program setting the printing device into the error print output execution mode when the identification code is not sent and setting the printing device into the error print output non-execution mode when the identification code is sent.

* * * * *